US007434657B2

(12) United States Patent
Nieschwitz et al.

(10) Patent No.: US 7,434,657 B2
(45) Date of Patent: Oct. 14, 2008

(54) ACOUSTIC FOAM SOUND REDUCER FOR VACUUM POWER UNIT

(75) Inventors: Darrell V. Nieschwitz, Louisville, OH (US); Andrew L. Gabric, Louisville, OH (US)

(73) Assignee: H-P Products, Inc., Louisville, OH (US)

( * ) Notice: Subject to any disclaimer, the term of this patent is extended or adjusted under 35 U.S.C. 154(b) by 342 days.

(21) Appl. No.: 11/260,527

(22) Filed: Oct. 27, 2005

(65) Prior Publication Data

US 2006/0070797 A1 Apr. 6, 2006

Related U.S. Application Data

(63) Continuation-in-part of application No. 29/205,218, filed on May 11, 2004, now abandoned.

(51) Int. Cl.
*F01N 3/021* (2006.01)

(52) U.S. Cl. ..... 181/231; 181/224; 181/225; 15/326; 96/382

(58) Field of Classification Search ..... 181/231, 181/224, 225; 15/326; 96/382
See application file for complete search history.

(56) References Cited

U.S. PATENT DOCUMENTS

| | | | | |
|---|---|---|---|---|
| 2,328,236 | A | 8/1943 | Stoner | |
| 2,731,194 | A | 1/1956 | Kent | |
| 2,748,883 | A * | 6/1956 | Ralph | 181/258 |
| 2,907,405 | A * | 10/1959 | Marshall | 55/309 |
| 2,943,698 | A | 7/1960 | Bishop | |
| 2,948,210 | A | 8/1960 | Conlan | |
| 3,898,063 | A | 8/1975 | Gazan | |
| 4,015,683 | A | 4/1977 | Williams | |
| 4,356,591 | A | 11/1982 | Lude | |
| 4,435,877 | A | 3/1984 | Berfield | |
| 4,786,299 | A | 11/1988 | DeMarco | |
| 4,938,309 | A | 7/1990 | Emdy | |
| D337,914 | S | 8/1993 | McDonald | |
| 5,248,323 | A * | 9/1993 | Stevenson | 95/90 |
| 5,293,664 | A * | 3/1994 | Lim et al. | 15/326 |
| 5,297,990 | A * | 3/1994 | Renz et al. | 454/187 |
| 5,400,463 | A | 3/1995 | Attard et al. | |
| 5,513,417 | A * | 5/1996 | Kim et al. | 15/326 |
| 5,548,867 | A | 8/1996 | Hwang et al. | |
| 5,720,074 | A | 2/1998 | Lee | |
| 5,737,797 | A * | 4/1998 | Rittmueller et al. | 15/326 |
| 5,765,257 | A * | 6/1998 | Steger et al. | 15/326 |
| 5,784,946 | A * | 7/1998 | Malosh et al. | 91/376 R |
| 5,894,114 | A * | 4/1999 | Eigenmann | 181/224 |

(Continued)

*Primary Examiner*—Edgardo San Martin
*Assistant Examiner*—Jeremy Luks
(74) *Attorney, Agent, or Firm*—Sand & Sebolt

(57) ABSTRACT

A power unit for an in-wall vacuum cleaning system has a first compartment which contains a motor for producing a vacuum at remote wand receptacles and a second compartment for separating and collecting the debris. An improved sound reducer is mounted in the motor compartment for reducing the sound level emitted by the motor and providing good cooling airflow for the motor. The sound reducer includes a disc-shaped base having a central opening for receiving a portion of the motor and a pair of partitions mounted on the base and forming a plurality of irregularly-shaped sound passages for breaking up the sound waves traveling therethrough. The base and partitions are formed of an acoustic foam which assist in absorbing the sound waves.

12 Claims, 11 Drawing Sheets

U.S. PATENT DOCUMENTS

| | | | | |
|---|---|---|---|---|
| 5,919,030 | A | 7/1999 | Iwatake et al. | |
| D417,534 | S | 12/1999 | Holston et al. | |
| D421,359 | S | 3/2000 | Liao | |
| 6,094,774 | A | 8/2000 | Larsen et al. | |
| D494,331 | S | 8/2004 | Nieschwitz et al. | |
| 6,804,857 | B1 * | 10/2004 | Olewiler, III | 15/326 |
| 2004/0083572 | A1 * | 5/2004 | Song | 15/347 |

* cited by examiner

ACOUSTIC FOAM SOUND REDUCER FOR VACUUM POWER UNIT

CROSS REFERENCE TO RELATED APPLICATIONS

This application is a continuation-in-part of pending U.S. Ser. No. 29/205,218, filed May 11, 2004.

BACKGROUND OF THE INVENTION

1. Technical Field

The invention relates to built-in vacuum cleaning systems in which a power unit containing a motor and a debris collection system is connected to various wall outlets through piping extending throughout the building. More particularly, the invention relates to such a power unit and to a sound reducer mounted in the unit to enhance the cooling and reduce the sound of the vacuum supplying motor mounted in the unit.

2. Background Information

Built-in vacuum cleaning systems are well-known in the building and cleaning industry and consists of a main power unit usually mounted in the basement or a garage for proper air circulation. The power unit contains a motor and a debris collection receptacle with various filters. When the motor is turned on, it creates a suction or vacuum at a plurality of wall outlets for drawing in dust and debris which is carried through tubing located in the walls of the building to the power unit where it is subsequently filtered and the cleaned air exhausted either to the outside or to a specific area in the building. Some examples of these in-wall vacuum cleaning systems are shown in U.S. Pat. Nos. 2,943,698 and 4,938,309. One problem with these types of systems is that the size of the motor required to generate the desired amount of vacuum can be relatively noisy when in operation which is annoying to the user thereof. Also it is desirable to provide adequate cooling for the motor to provide maximum efficiency and long motor life.

Thus, there has been a need to reduce the sound transmitted by the air vacuum motor by providing the unit with various types of sound dampening means while providing optimum cooling of the motor. Some examples of prior art systems having sound reducing means are shown in U.S. Pat. Nos. 2,731,194, 2,948,210, 4,786,299, 4,938,309, and 5,400,463. Although some of these cleaning systems and power units may have successfully dampened a certain amount of sound transmitted to the surrounding environment by the use of foam inserts, increased sound reduction is always desirable and with a less expensive and less complicated and bulky sound reducer than heretofore believed available. Also such foam inserts should not reduce the cooling of the motor by blocking the air passages thereto. The present invention is believed to achieve this result by the unique sound reducers described herein below.

BRIEF SUMMARY OF THE INVENTION

One aspect of the present invention is to provide an improved power unit for a vacuum cleaning system having a unique sound reducer mounted therein which increases the effectiveness of dampening the amount of sound produced by the vacuum producing motor mounted within the unit without materially affecting the cooling air flow for the motor.

Another feature of the present invention is to provide an improved sound reducer which is formed of an acoustic foam insert mounted within the unit having a single central opening for receiving a portion of the motor therein, wherein the sound reducer provides a plurality of irregularly-shaped sound wave passages to assist in dampening the amount of sound transmitted externally of the power unit into the surrounding environment.

A further feature of the present invention is to form the sound reducer which is mounted within the power unit of three components, namely a circular base formed with a central opening and a pair of partitions formed of the same foam material and preferably secured on the base by an adhesive.

Still another aspect of the present invention is to mount the sound reducer in the unit on an annular liner or ring mounted on the inside wall of the power unit for supporting the sound reducer base and partitions thereof, eliminating the need for expensive mounting arrangements for the sound reducer.

These objections and advantages are obtained by the improved power unit of the present invention, the general nature of which may be stated as comprising a canister having a side wall, top and bottom walls, a first compartment which houses a motor and a second compartment for collecting debris; an acoustic foam sound reducer mounted in the first compartment having a single central opening for receiving a portion of the motor therein; said sound reducer having first and second spaced partitions extending about a portion of the central opening and forming a plurality of passages communicating with said central opening to breakup sound waves generated by the motor and provide for the movement of cooling air therethrough.

These objectives and advantages are further obtained by the improved sound reducer of the present invention which comprises a circular base of acoustic foam formed with a single central opening adapted to receive a portion of the motor therein; a first piece of acoustic foam mounted on the circular base having a curved surface located concentrically with respect to the central opening; and a second piece of acoustic foam mounted on the base, said second piece having a curved surface located concentrically with respect to the central opening, said acoustic foam piece forming a plurality of air passages communicating with the central opening to dispense sound waves generated by the motor and providing cooling air for the motor.

BRIEF DESCRIPTION OF THE SEVERAL VIEWS OF THE DRAWINGS

A preferred embodiment of the invention, illustrated of the best mode in which Applicant contemplates applying the principles, is set forth in the following description and is shown in the drawings and is particularly and distinctly pointed out and set forth in the appended claims.

Similar numbers refer to similar parts throughout the drawings.

DETAILED DESCRIPTION OF THE INVENTION

Figure 1:
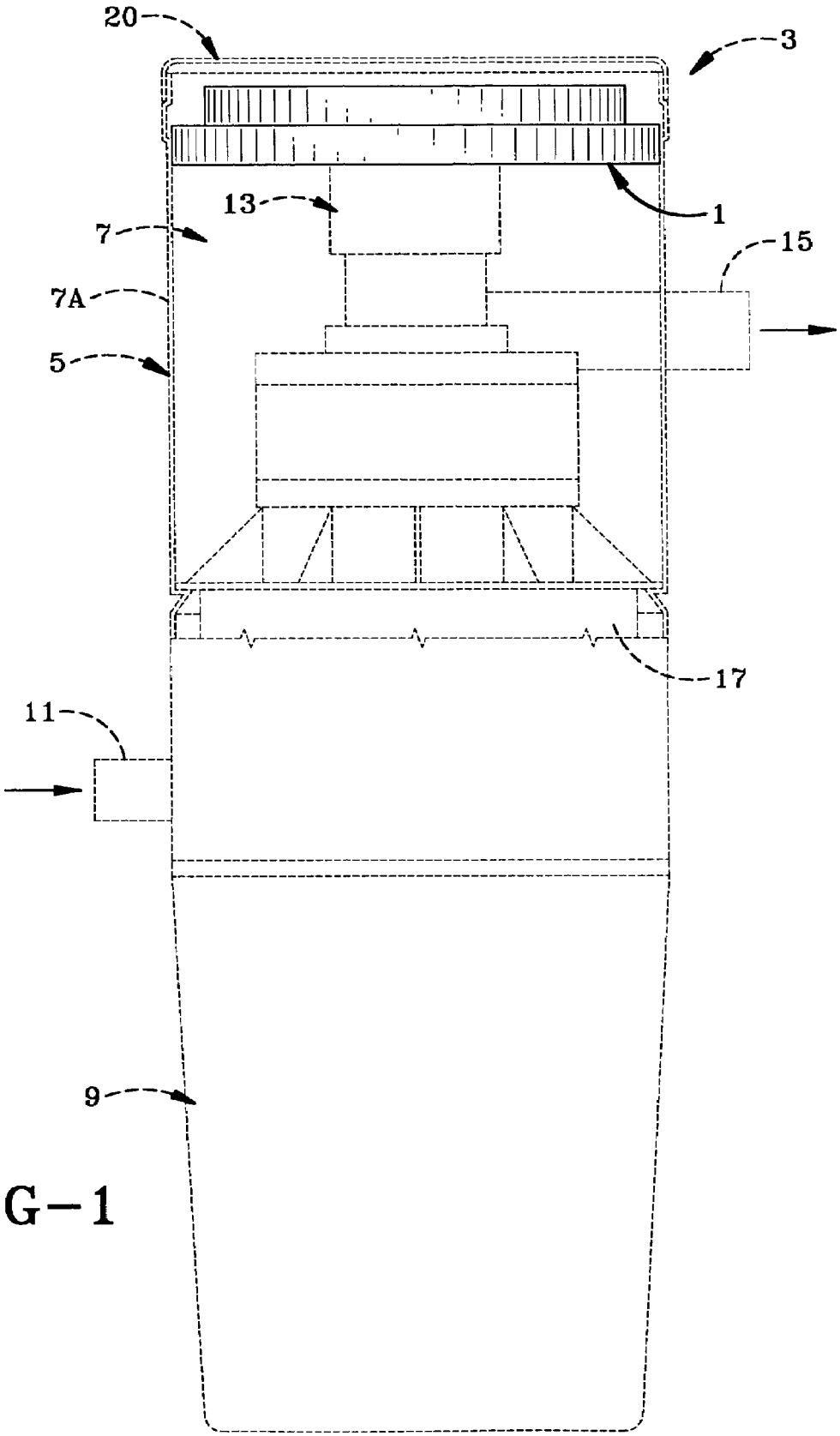
FIG. 1 is a diagrammatic view of the improved sound reducer of the present invention shown in full lines mounted within a power unit shown in dot dashed lines.

A first embodiment of the improved sound reducer and power unit containing the same is shown in FIG. 1. The sound reducer is indicated generally at 1 and is shown in full lines with the vacuum cleaning unit shown in dot dashed lines, and indicated generally at 3. Vacuum cleaning power unit 3 is of a construction well-known in the art and consists of a main canister indicated generally at 5, having an annular configuration and formed with an upper motor compartment 7 and a lower debris collection compartment 9. Some type of filtering mechanism (not shown), such as a cyclonic unit or filter medium will be mounted between motor compartment 7 and debris compartment 9 to filter out the dust, dirt and other debris which enters debris compartment 9 through an intake line 11. Line 11 communicates with the various outlets spaced throughout the building in which a cleaning wand will be attached.

A vacuum producing motor 13 is mounted in motor compartment 7 and usually communicates with an exhaust tube 15 which extends to the outside of the building or have a muffler or other device mounted thereon for controlling the exhaust air after it has been cleaned by the filters within compartment 9. Motor compartment 7 is separated from debris compartment 9 by various types of walls or partitions 17 which also may supply the structural support for motor 13. All of these components are well-known in the art, examples of which may be found in U.S. Pat. Nos. 4,591,368, 4,938,309, 5,400,463, 6,237,186, the contents of which are incorporated herein by reference.

Figure 1A:
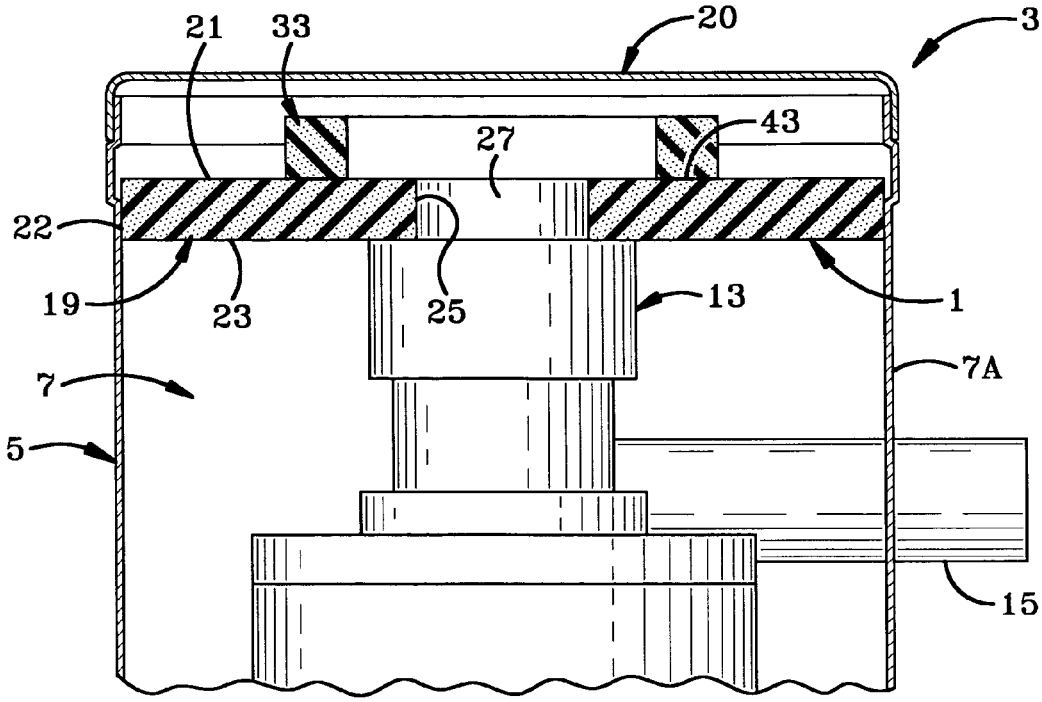
FIG. 1A is a fragmentary view of the upper portion of FIG. 1 with the sound reducer shown in section mounted on the motor of the power unit.
Figure 2:
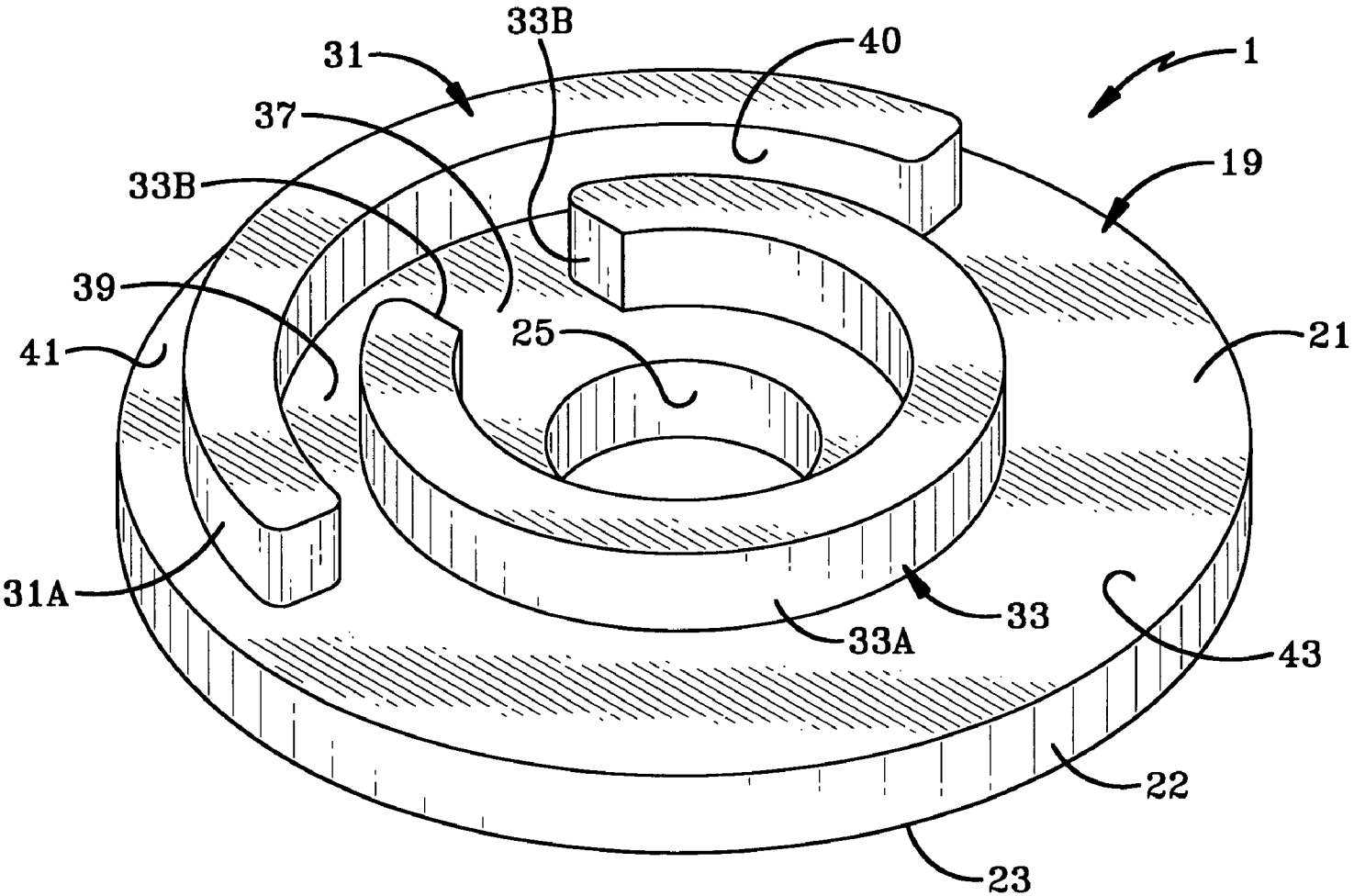
FIG. 2 is a top perspective view of a first embodiment of the sound reducer of the present invention.
Figure 3:
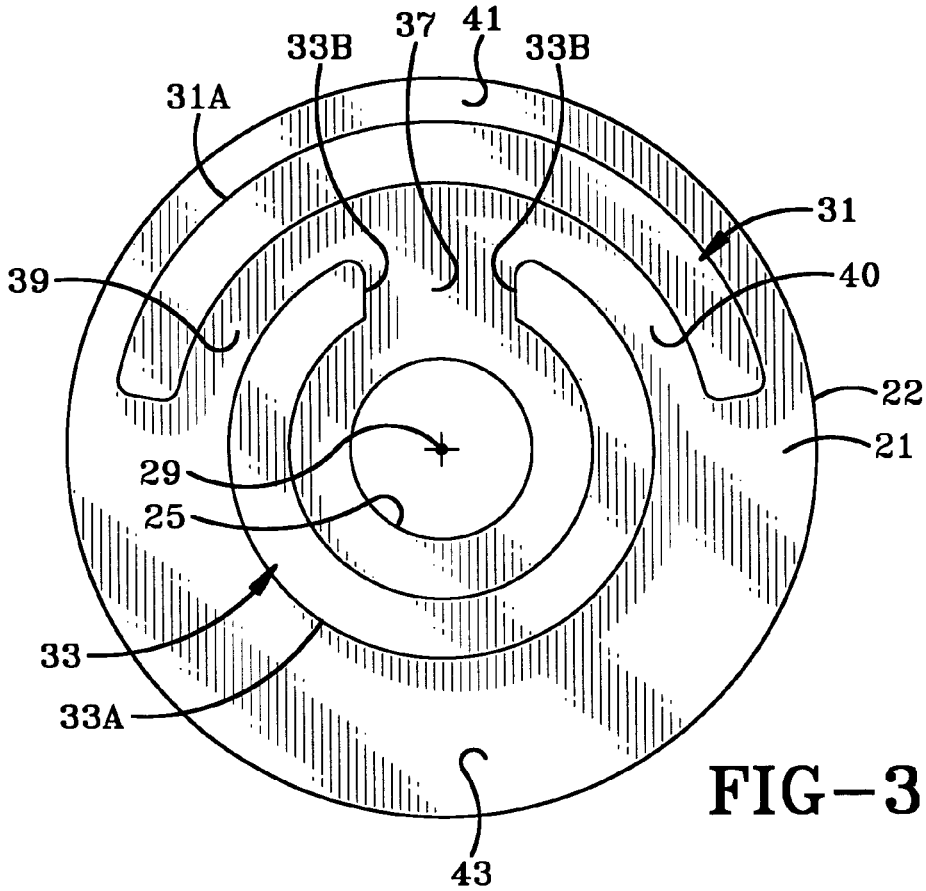
FIG. 3 is top plan view of FIG. 2.
Figure 4:
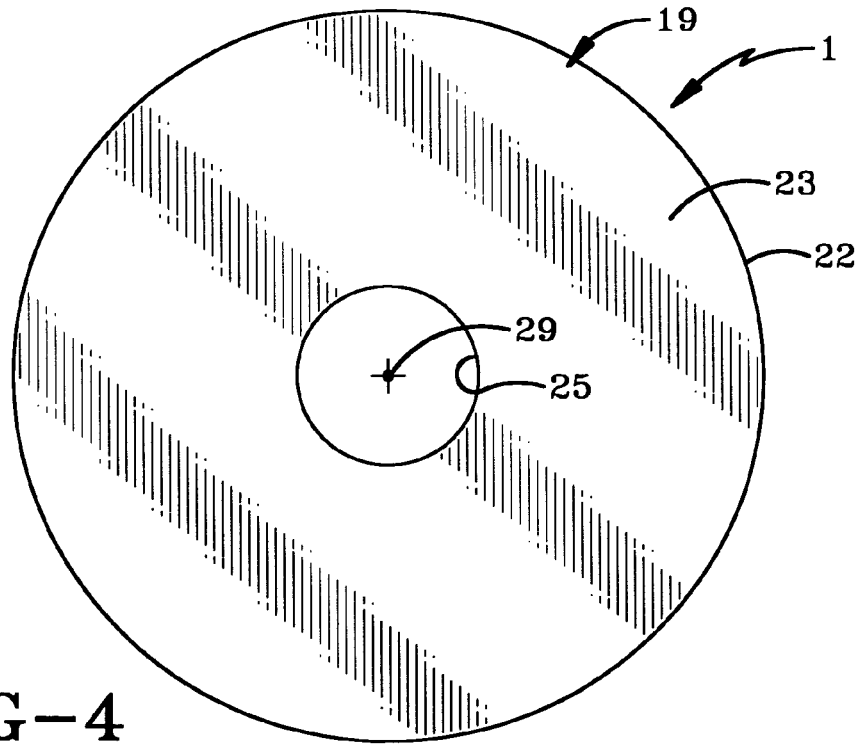
FIG. 4 is a bottom plan view of FIG. 3.
Figure 5:
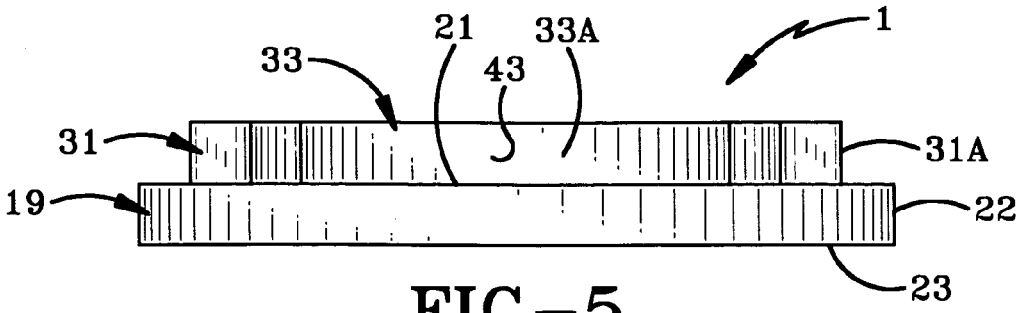
FIG. 5 is a front elevational view of FIG. 3.
Figure 6:
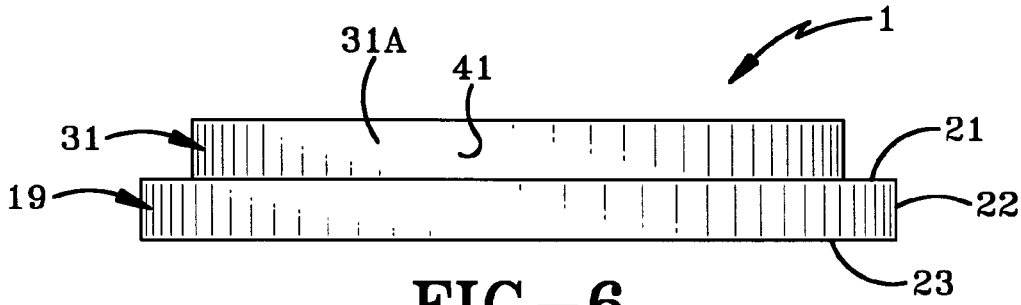
FIG. 6 is a rear elevational view of FIG. 3.
Figure 7:
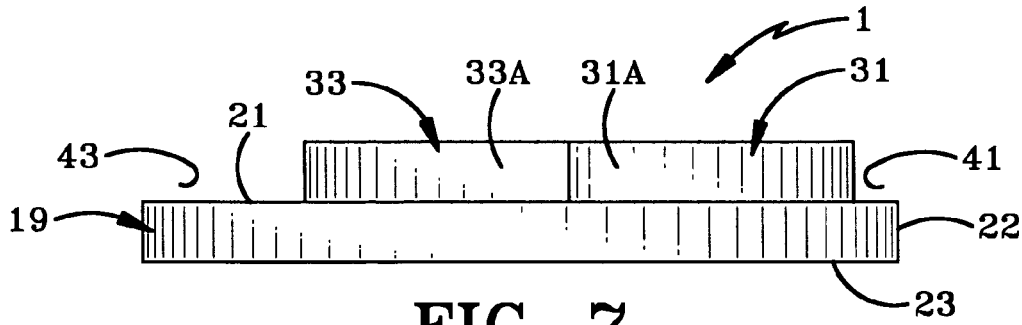
FIG. 7 is a left side elevational view of FIG. 3.
Figure 8:
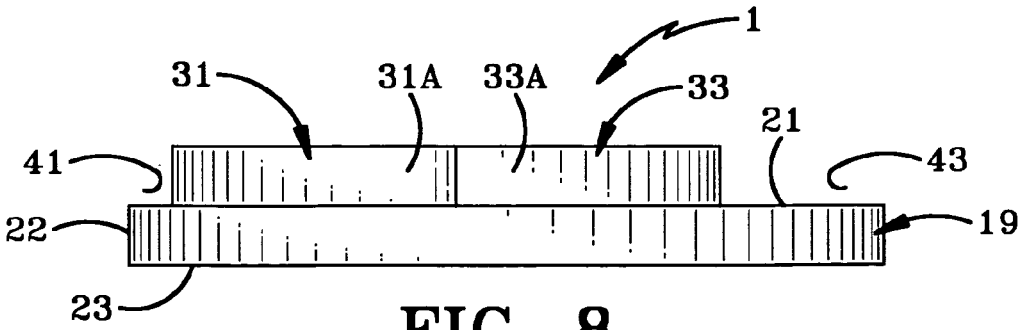
FIG. 8 is a right side elevational view of FIG. 3.

The first embodiment of sound reducer 1 is shown in FIGS. 2-8 and includes an annular disc-shaped base indicated generally at 19, having planar top and bottom surface 21 and 23 and a cylindrical side surface 22. Base 19 is formed with a circular central opening 25 into which an upper portion 27 of motor 13 is inserted as shown in FIG. 1A. A pair of partition members 31 and 33 are mounted on top surface 21 of base 19, each of which has an arcuate, generally crescent-shaped configuration as best shown in FIGS. 2 and 3 and partially circumscribes central opening 25. Partition 31 has an angle of curvature centered about the center point or axis 29 of opening 25 and is located inwardly of the outer periphery or side surface 22 of base 19. Outer partition 31 preferably has an arcuate length of between 150° and 170° with the preferred length being 160°. Inner partition member 33 is located inwardly of outer partition member 31 and extends concentrically about central opening 25 having the same center point 29 and extends throughout an arc of between 300° and 320°, with the preferred arcuate length being 310°. Inner partition member 33 partially circumscribes opening 25 and extends partially into the area circumscribed by partition 31. Partition 33 circumscribes opening 25 except for a sound wave passage 37 formed between partition ends 33B, which passage communicates with a pair of curved sound wave passages 39 and 40 which extend between the adjacent side walls of outer partition 31 and inner partition 33 as shown in FIG. 3. Another sound wave passage 41 is formed between the outer side wall surface 31A of partition 31 and the inside surface of motor compartment side walls 7A. Still another larger sound passage 43 is formed in the remaining portion defined by the outer surface or side wall 33A of inner partition 33 and compartment side wall 7A. These numerous and non-linear sound passages assist in breaking up a good portion of the sound waves produced by motor 13 as they travel about sound reducer 1, as well as being absorbed by the acoustic foam material of reducer 1. These passages also provide cooling passages for supplying cooling air to motor 13 through vent openings formed in the lid 20. Top portion 27 of motor 13 contains the fan for drawing cooling air into motor 13.

As shown in FIG. 1A, sound reducer 1 preferably consists of three separate parts. Disc-shaped base 19 and the pair of crescent-shaped partitions 31 and 33 which preferably are secured to top surface 21 of base 19 by an adhesive 43. These three components are all one-piece members formed of an acoustic foam, preferably a fire retardant non-reticulated polyester foam.

Figure 9:
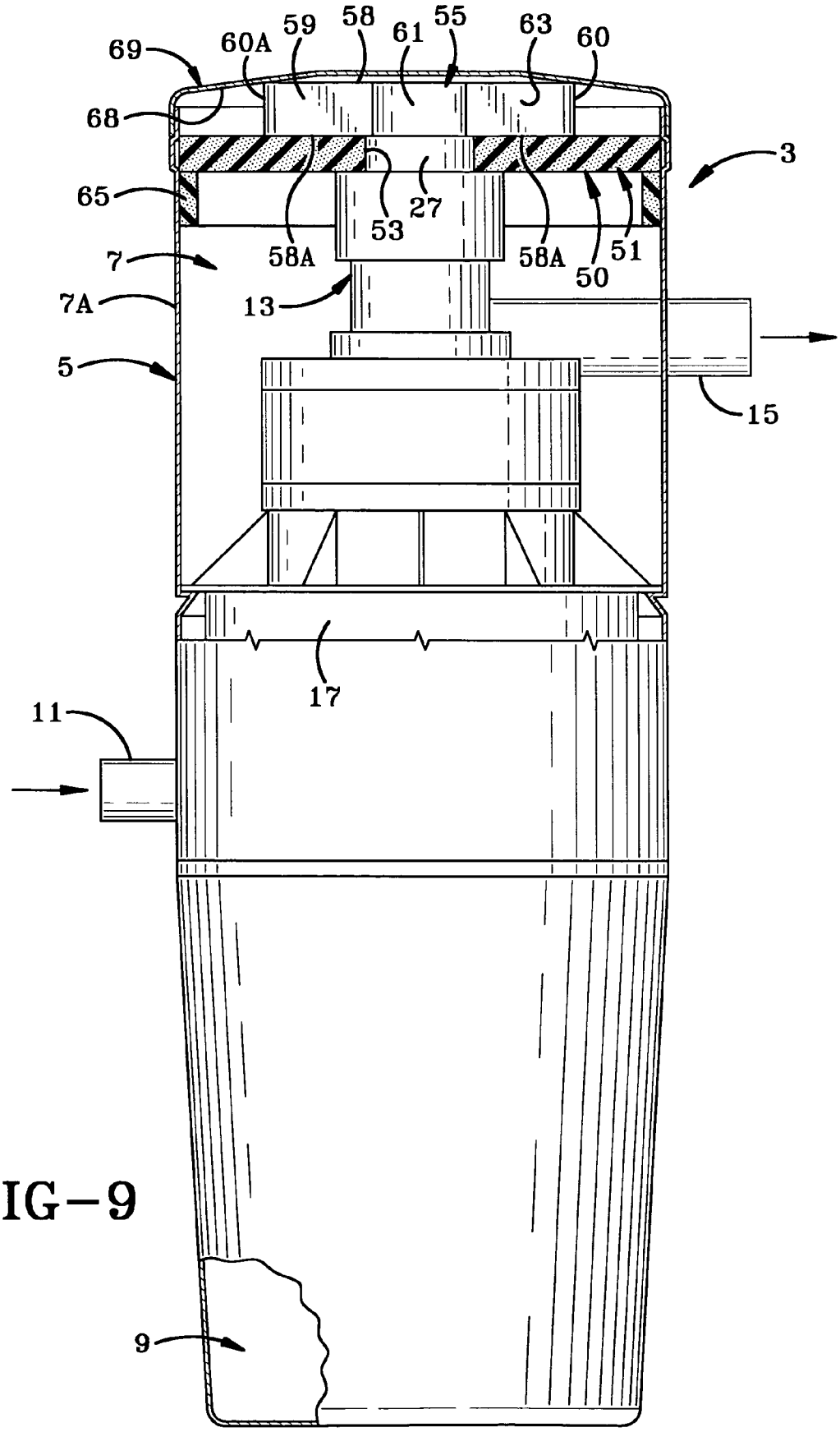
FIG. 9 is a view similar to FIG. 1 showing a second embodiment of the sound reducer shown in section, mounted within a power unit.
Figure 10:
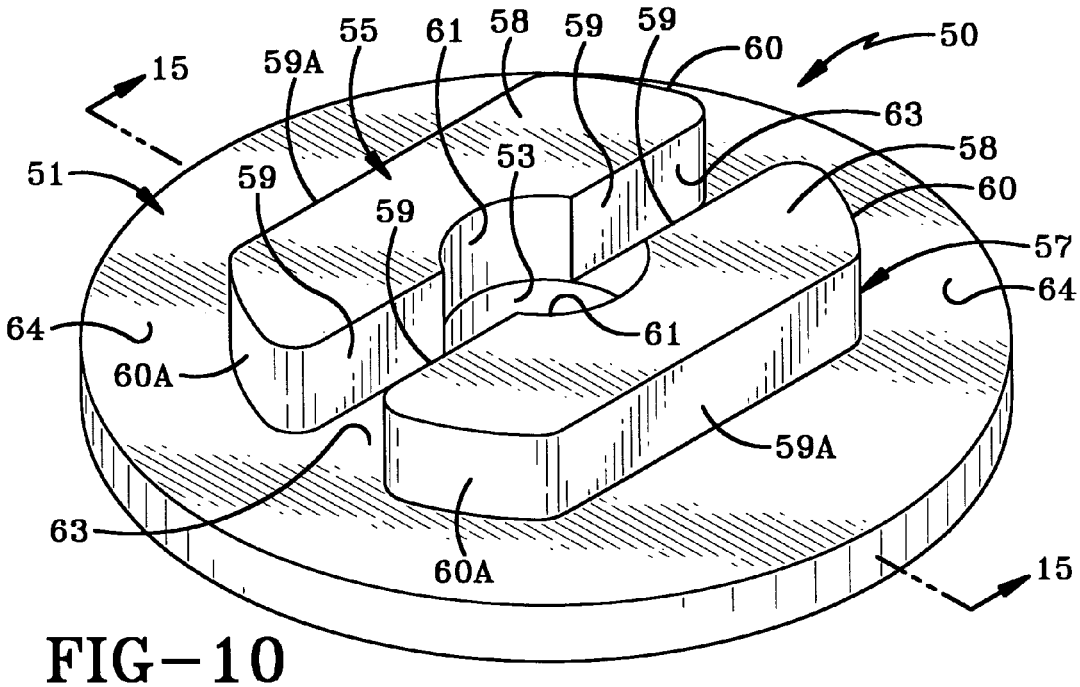
FIG. 10 is a top perspective view of the sound reducer of FIG. 9.
Figure 10A:
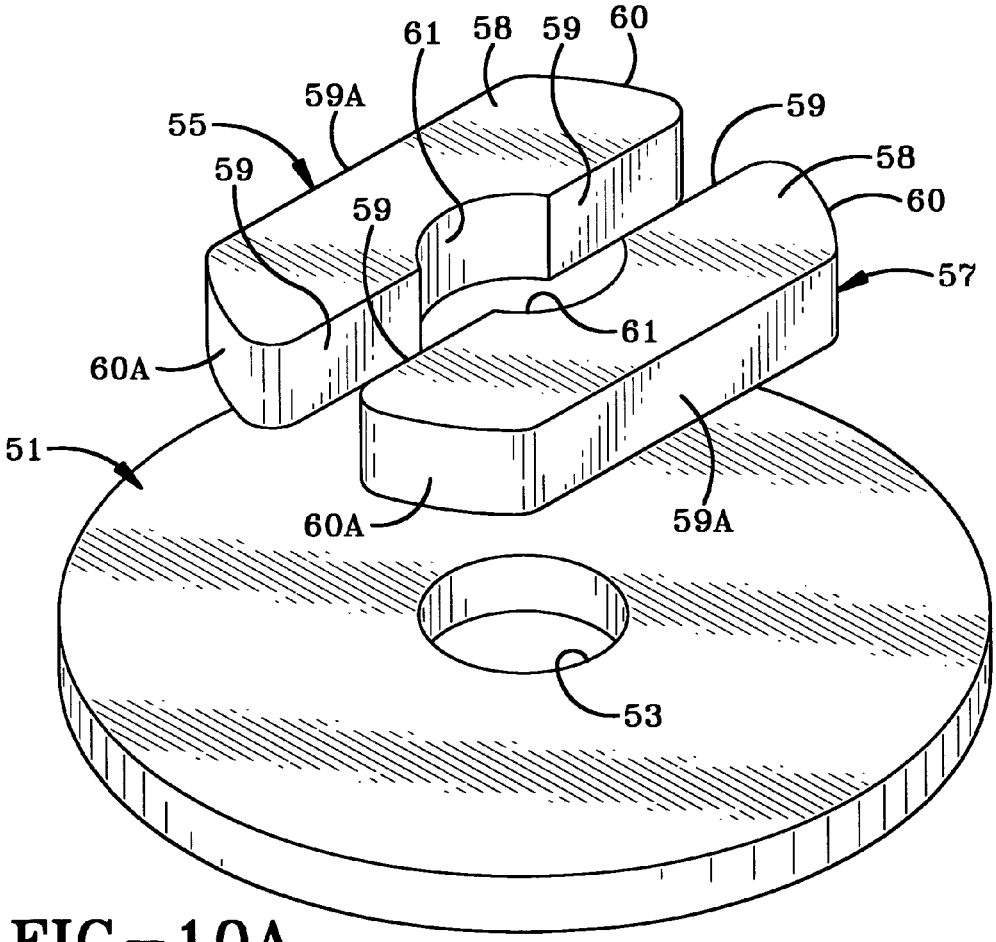
FIG. 10A is an exploded perspective view of FIG. 10.
Figure 11:
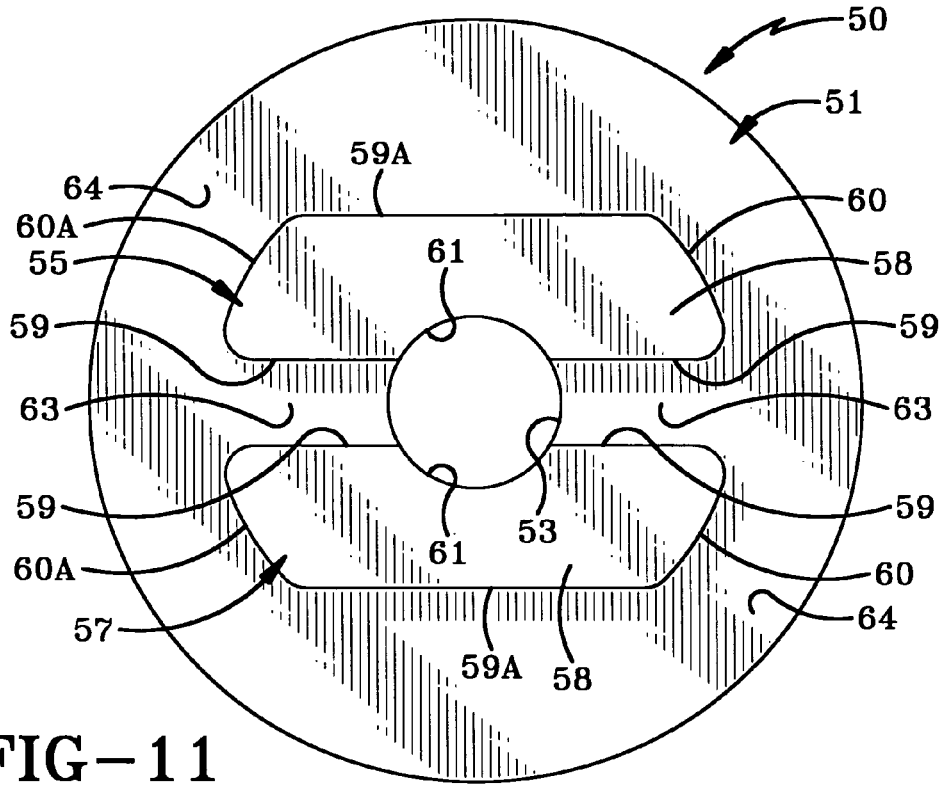
FIG. 11 is a top plan view of FIG. 10.
Figure 12:
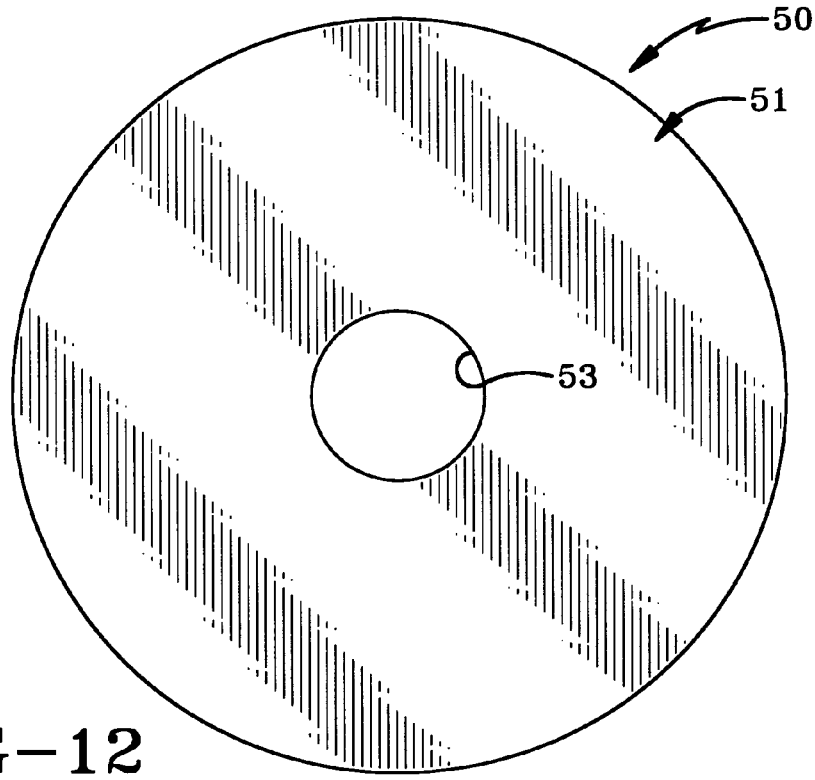
FIG. 12 is a bottom plan view of FIG. 10.
Figure 13:
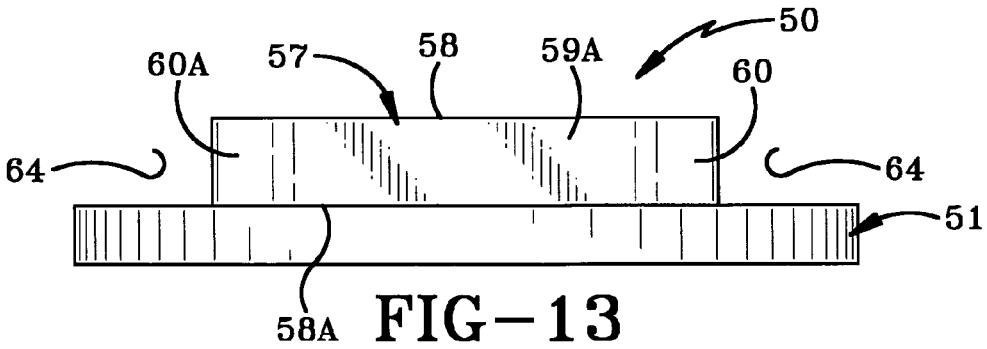
FIG. 13 is a front elevational view of FIG. 11.
Figure 14:
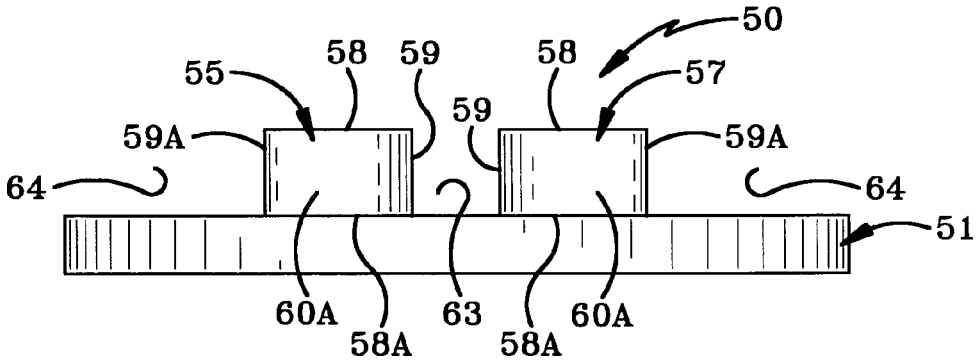
FIG. 14 is a side elevational view of FIG. 11.

A modified or second embodiment sound reducer is indicated generally at 50, and is shown particularly in FIGS. 9-16. Sound reducer 50 includes a disc-shaped base 51 very similar to base 19 described above, and is formed with a central opening 53. In embodiment 50, the crescent-shaped partitions 31 and 33 are replaced with somewhat rectangular-shaped partitions 55 and 57, which preferably are similar in size and shape to each other to reduce the number of components required for forming sound reducer 50. Each partition 55 and 57 has spaced parallel top and bottom surfaces 58 and 58A, spaced parallel side surfaces 59 and 59A and curved connecting end surfaces 60 and 60A. An arcuate-shaped cutout 61 extends inwardly from each flat planar side surface 59 and has an arcuate length of approximately 120°, and is located diametrically opposite each other and coincides with the axis of central opening 53 as shown in FIG. 11. These cutouts surround and are in close proximity with or contact top motor portion 27 as shown in FIG. 9.

Figure 15:
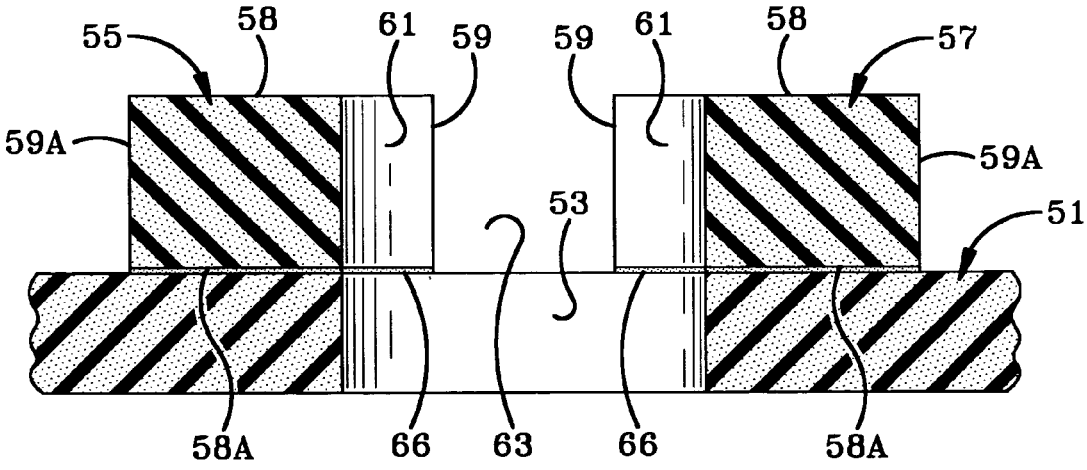
FIG. 15 is an enlarged fragmentary sectional view taken on line 15-15, FIG. 10.

Second embodiment 50 also is formed of three separate components, base 51 and partitions 55 and 57, each of which is an acoustic foam material such as the non-reticulated polyester foam as are the components of sound reducer 1. Also as shown in FIG. 15, partitions 55 and 57 are mounted on base 51 and secured thereto by use of an adhesive 66 or other types of attachment means, such as heat fusion or other types of bonding. This construction enables base 51 to be formed easily from a sheet of foam material followed by the mounting of similar partition members 55 and 57 thereon. Preferably partition members 55 and 57 are identical, thus requiring only two components for forming sound reducer 50 thereby reducing inventory of parts and reduces the cost of manufacture.

Figure 16:
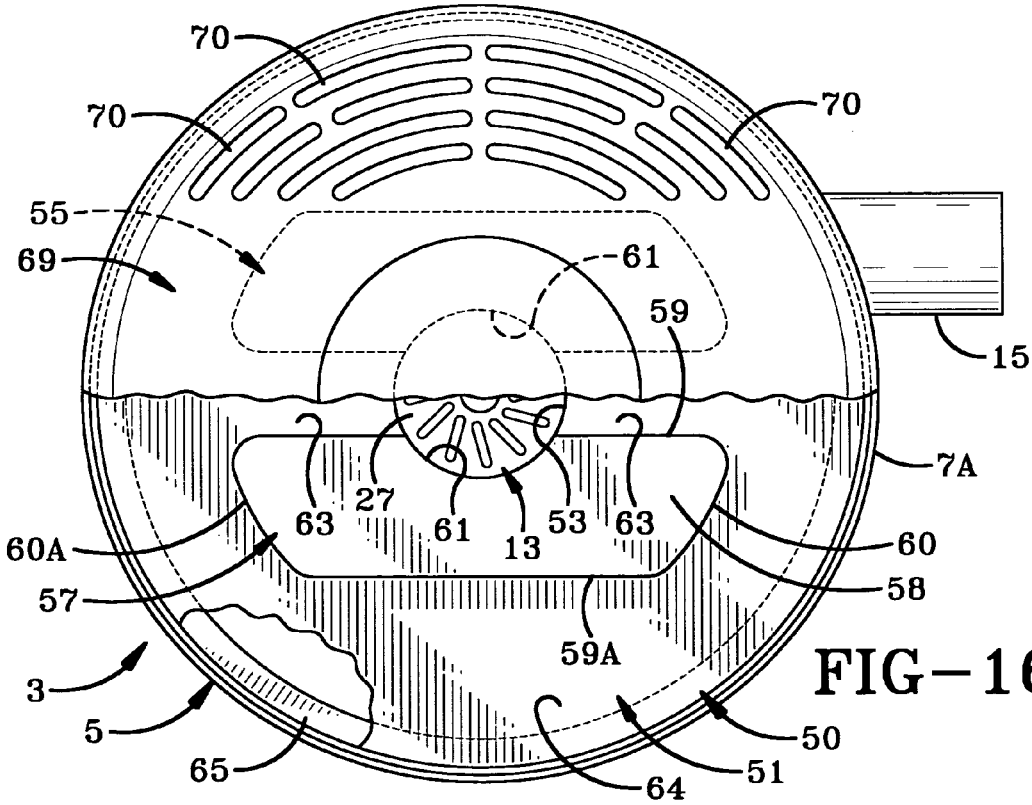
FIG. 16 is a top plan view of the power unit of FIG. 9 with portions of the lid broken away.

When partitions 55 and 57 are mounted on base 51, a pair of linear passages 63 (FIG. 11) are formed between the partitions side surfaces 59 and are in direct communication with central opening 53 and correspondingly with motor portion 27. These passages direct the sound waves along the passages and into a large annular passage 64 which extends about the periphery of base 51 where the sound waves can be broken up by the various surfaces of partitions 55 and 57 and absorbed by the acoustic foam material from which sound reducer 50 is formed. Also motor 13 is cooled by drawing air into annular passage 64 through vents 70 formed in lid 69 as shown in FIG. 16 for subsequent discharge through other vent holes (not shown) formed in the canister wall of motor compartment 7.

Sound reducer 50 is mounted in the upper portion of motor compartment 7 as shown in FIG. 9, by supporting it on an annular foam liner or strip 65 which is secured to canister side wall 7 by an adhesive or other type of attachment. Liner 65 insures that sound reducer 50 remains in its intended position within the upper portion of compartment 7 and preferably in contact with motor portion 27. Liner 65 need not be a complete ring and can be one or more arcuate portions if desired. Furthermore, as shown in FIG. 9, the outer portions of top surfaces 58 of partitions 55 and 57 are closely adjacent to and preferably engage the underside surface 68 of lid 69. This assists in properly positioning sound reducer 50 in its intended location and prevents the traveling of sound waves completely along the underside surface of lid 69 assisting in breaking up of the sound waves and reducing the sound level produced by motor 13. Also, the top surface of arcuate projections 31 and 33 could also engage the underside surface of the canister lid as shown in FIG. 1 to further assist the movement of the sound waves.

Figure 17:
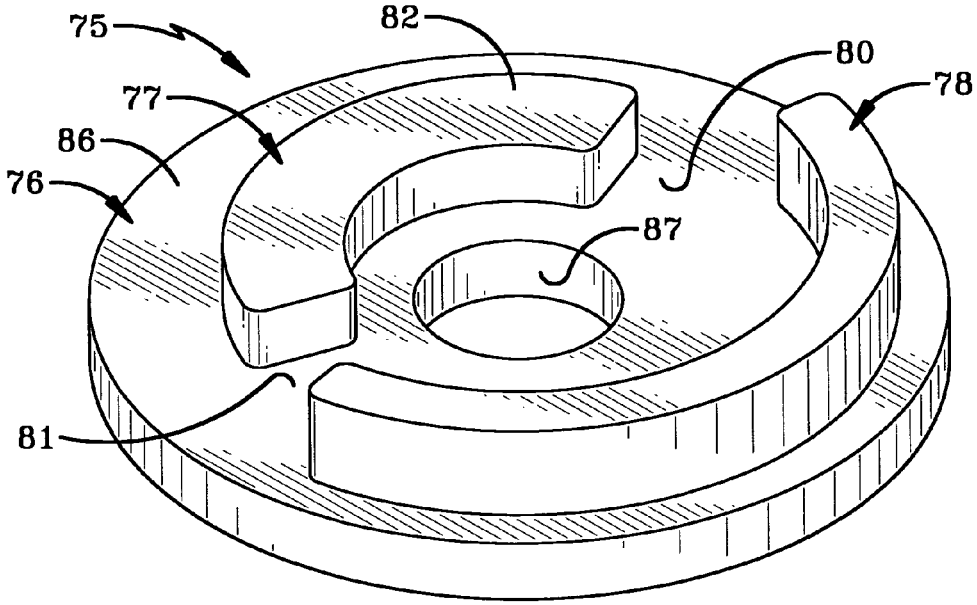
FIG. 17 is a top perspective view of a third embodiment of the sound reducer of the present invention.
Figure 18:
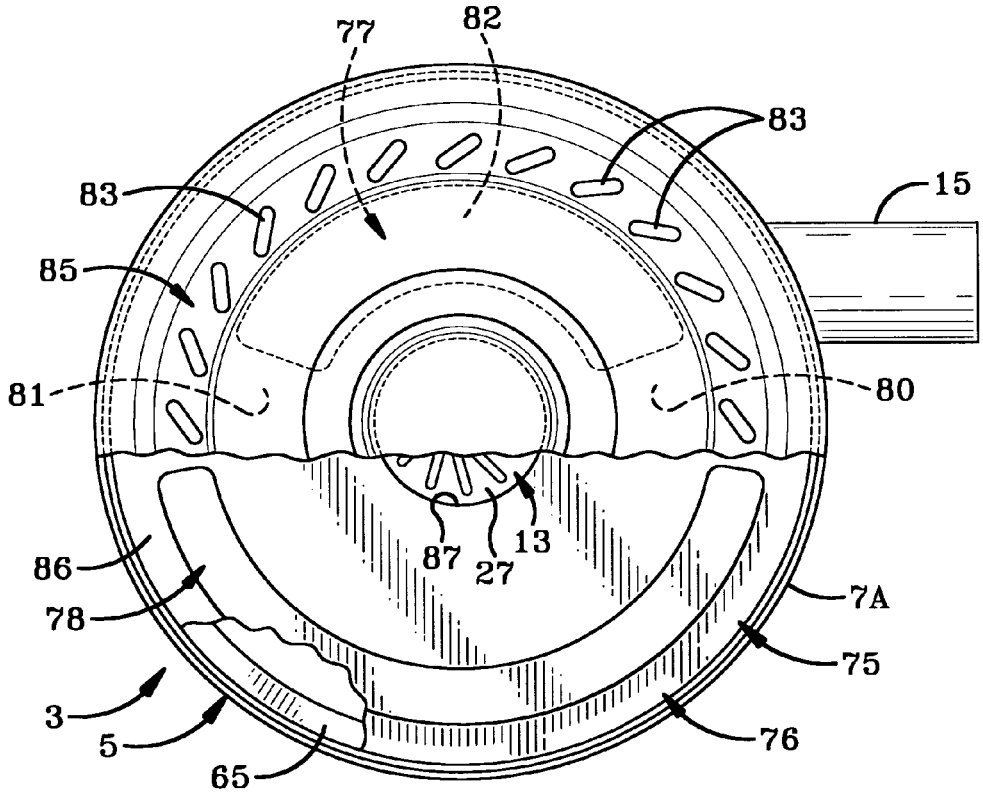
FIG. 18 is a top view similar to FIG. 16 showing the embodiment of FIG. 17 in the top portion of the power unit.
Figure 19:
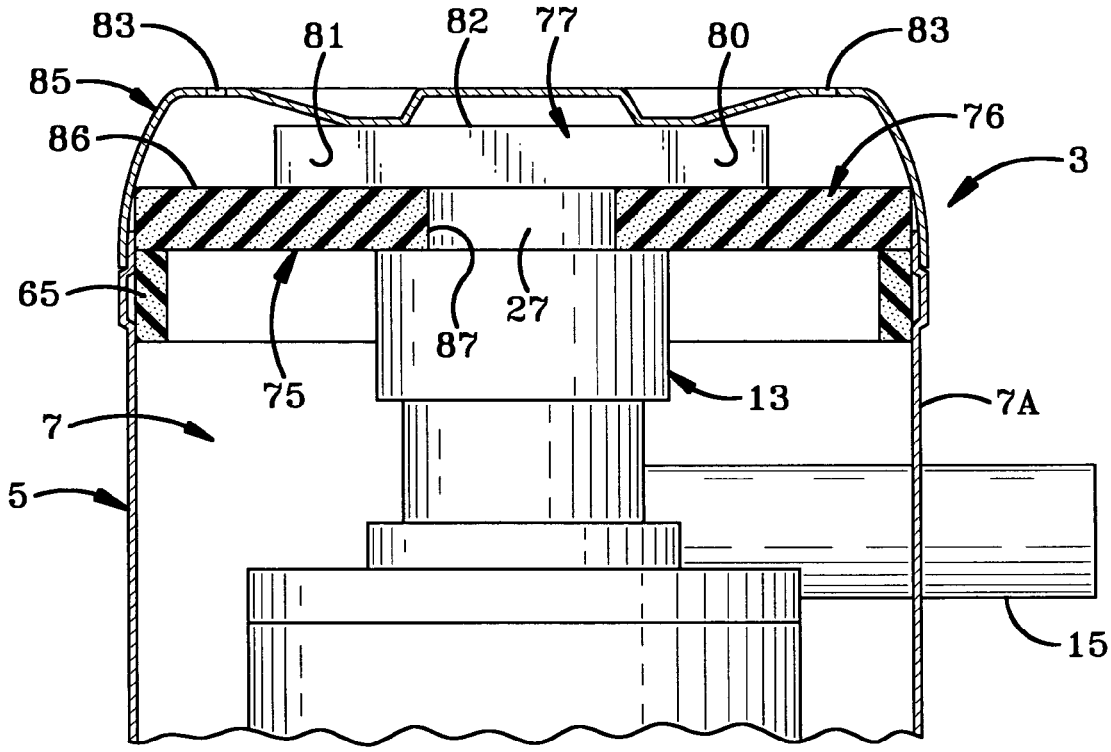
FIG. 19 is a fragmentary view with portions in section showing the sound reducer of FIG. 17 mounted in the top portion of the power unit.

A third embodiment of the improved sound reducer is indicated generally at 75, and is shown in FIGS. 17-19. Sound reducer 75 is very similar to the construction of sound reducer 1 in that it includes an annular base member 76 and a pair of arcuate-shaped partitions 77 and 78. Outer partition 78 is very similar to partition 31 of sound reducer 1 having an arcuate length of between 150° and 170° with the preferred length being 160°. Arcuate partition 77 has a shorter arcuate length of between 130° and 150° with the preferred arcuate length being 140°. Also, as can be seen in FIG. 17, partition 77 has a shorter height than that of partition 78. For example, partition 77 has a height of one inch and partition 78 has a height of one and one-half inches. This enables the air to flow through the various sound and cooling passages from motor portion 27 and through passages 80 and 81 and over top surface 82 of partition 77 to vent openings 83 formed in canister lid 85. These passages also provide the irregularly shaped routes through which the sound waves move which assist in breaking up the sound waves as they are being absorbed by the foam material of sound reducer 75 as discussed above.

Again, sound reducer 75 is preferably formed of three separate components of the same material discussed previously, and with arcuate partitions 77 and 78 being secured on the top surface 86 of base 76 by an adhesive or other type of attachment means. Again, base 76 is formed with a central opening 87 similar to openings 25 and 53 discussed above, for receiving the circular top portion 27 of motor 13 therein. Also, as shown in FIG. 19 sound reducer 75 preferably is supported within the top portion of canister 5 by liner 65. The remaining features of the embodiment shown in FIGS. 17-19 is similar to that described above with respect to sound reducers 1 and 50.

In summary, the improved sound reducers 1, 50 and 75 provide a very inexpensive yet highly efficient means of reducing the sound level produced by the motor of an in-wall vacuum cleaning power unit by forming the sound reducers of three simple components of an acoustic foam, two of which are mounted on a disc-shaped base preferably by an adhesive, which partitions form a plurality of sound passages which will break up the sound waves thereby reducing the sound level produced by the power unit motor. Preferably, all three components are formed of the same material to assist in the cost reduction and ease of manufacture. However the partitions could be formed of a different foam material than that of the base if desired without affecting the concept of the invention. Also, the general shapes of the partitions as shown in the drawings and discussed above could vary somewhat without affecting the sound reduction performance of the sound reducers, although the two embodiments shown in the drawings and described above have been proven to produce satisfactory results.

Also, the passageways formed by the sound reducers provide for the flow of the cooling air to the vacuum unit motor through the lid vents for subsequent exhaust to the surrounding atmosphere through vent openings formed in the canister body. Thus, in addition to providing the desired sound reduction, the sound reducers assist in supplying cooling air to the motor to provide for a cooler running motor thereby increasing its life and operational efficiency.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. A power unit for a vacuum cleaning system comprising a canister having a side wall, top and bottom walls, a first compartment which houses a motor and a second compartment for collecting debris; an acoustic foam sound reducer mounted in the first compartment having a single central opening for receiving a portion of the motor therein; said sound reducer including a disc-shaped base and first and second spaced partitions extending about a portion of the central opening and forming a plurality of sound passages communicating with said central opening to dispense sound waves generated by the motor; said first and second partitions each having a generally rectangular shape with parallel top and bottom surfaces with arcuate end surfaces extending between side surfaces thereof and having spaced opposed side surfaces, each formed with an arcuate cutout aligned with the circular opening of the base and together forming a portion of a circular opening for receiving a portion of the motor therein.

2. The power unit defined in claim 1 wherein each of the first and second partitions is a one piece member mounted on a top surface of the disc-shaped base by an adhesive.

3. The power unit defined in claim 2 wherein the base and pair of partitions are formed of non-reticulated polyester foam.

4. The power unit defined in claim 1 wherein the first and second partitions are substantially similar to each other.

5. The power unit defined in claim 1 wherein an acoustic foam liner is mounted on the sidewall of the canister within the first compartment; and in which the sound reducer is supported on the foam liner.

6. A sound reducer for a vacuum power unit having a motor chamber and a motor located therein, said sound reducer comprising a circular base of acoustic foam formed with a single central opening adapted to receive a portion of the motor therein;

a first piece of acoustic foam mounted on the circular base having a curved surface located concentrically with respect to the central opening; and a second piece of acoustic foam mounted on the base, said second piece having a curved surface located concentrically with respect to the central opening, said acoustic foam pieces forming a plurality of sound passages communicating with the central opening to dispense sound waves generated by the motor; each of the curved surfaces being an arcuate cutout which is complementary to and axially aligns with a portion of the central opening of said base, said first and second foam pieces being mounted diametrically opposite of each other about said central opening forming a sound passage therebetween; and wherein each of the first and second foam pieces has a generally flat planar side surface in which the arcuate cutout is formed, said side surfaces of said first and second foam pieces being substantially parallel to each other and forming one of the sound passages therebetween.

7. The sound reducer defined in claim 6 wherein the first foam piece is spaced inwardly from the outer perimeter of the circular base forming an arcuate sound passage extending about the outer perimeter of said first foam piece.

8. The sound reducer defined in claim 6 wherein the base is a one piece member and has planar top and bottom surfaces; in which each of the first and second pieces of foam is a one piece members; and in which said first and second foam pieces are secured to the top surface of the base by an adhesive.

9. The sound reducer defined in claim 6 wherein each of the first and second foam pieces are equal in height.

10. The sound reducer defined in claim 6 wherein the arcuate length of each of the arcuate cutouts formed in the first and second pieces is approximately 120°.

11. The sound reducer defined in claim 6 further includes an annular strip of foam material adapted to be mounted within the power unit for supporting the circular base thereon.

12. A sound reducer for a vacuum power unit having a motor chamber and a motor located therein, said sound reducer comprising a circular base of acoustic foam formed with a single central opening adapted to receive a portion of the motor therein;

a first piece of acoustic foam mounted on the base and having a first arcuate cutout located concentrically with respect to the central opening;

a second piece of acoustic foam mounted on the base having a second arcuate cutout located concentrically with respect to the central opening and located diametrically opposite the first cutout;

said first and second foam pieces each having a side surface in which the arcuate cutout is formed, said side surfaces being spaced from each other and forming a first sound passage therebetween which communicates with the central opening to dispense sound waves generated by the motor; and said first and second foam pieces being spaced inwardly from an outer perimeter of the circular base forming a continuous annular sound passage extending about the outer perimeter of said foam base and communicating with the first sound passage between the first and second acoustic foam pieces.

* * * * *